US006321466B1

(12) United States Patent
Bordin et al.

(10) Patent No.: US 6,321,466 B1
(45) Date of Patent: Nov. 27, 2001

(54) REMOVABLE TONGUE FOR A SHOE AND ATTACHMENT DEVICE THEREFOR

(75) Inventors: Mario Bordin, Asolo (IT); Jérôme Chaigne, Gruffy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/534,332

(22) Filed: Mar. 24, 2000

(30) Foreign Application Priority Data

Mar. 26, 1999 (FR) ..... 99 03915

(51) Int. Cl.[7] ..... A43B 23/26; A43Y 11/00

(52) U.S. Cl. ..... 36/54; 36/136; 36/51; 36/50.1; 24/68 R

(58) Field of Search ..... 36/54, 55, 88, 36/100, 132, 136, 50.1, 50.5, 51, 71, 10, 101; 24/68 R, 70 SK, 70 ST, 69 SK, 71 ST, 71 SK

(56) References Cited

U.S. PATENT DOCUMENTS 4,126,951 * 11/1978 Antonious ..... 36/54
4,748,751 * 6/1988 Sartor ..... 36/50.1
4,805,321 2/1989 Tonkel .
4,920,666 5/1990 Marega .
5,311,679 * 5/1994 Birch, Sr. ..... 36/132
5,459,947 10/1995 Lasher .
5,926,978 * 7/1999 Smith ..... 36/101
6,128,801 * 10/2000 Adzick et al. ..... 36/136

FOREIGN PATENT DOCUMENTS 2323417 11/1974 (DE) .
0317798 5/1989 (EP) .
2682858 4/1993 (FR) .

* cited by examiner

*Primary Examiner*—Anthony Stashick
(74) *Attorney, Agent, or Firm*—Greenblum & Bernstein, P.L.C.

(57) ABSTRACT

A footwear that opens at the front and has a tongue for protecting the top of the foot, which is adjustable in position by way of a fixing system. The fixing system is constituted of a flexible band which, provided with woven strips on one surface, is folded over itself at one free end to form a loop that winds on a device that attaches the tongue. The invention allows the removability of the tongue, as well as its continuous adjustment longitudinally to the footwear, while guaranteeing the solid retention thereof on the front end of the latter.

18 Claims, 2 Drawing Sheets

REMOVABLE TONGUE FOR A SHOE AND ATTACHMENT DEVICE THEREFOR

BACKGROUND OF THE INVENTION

1. Field of the Invention

The present invention relates to an item of footwear, i.e., a shoe or boot, that opens at the front and has a tongue for protecting the top of the foot. More particularly, the present invention relates to a comfort tongue adapted to come into contact directly with the top of the foot and to a system for attaching the tongue to the item of footwear.

2. Description of Background and Relevant Information

The known footwear of the type mentioned above generally relate to all flexible shoes adapted to walking and running, and to the so-called "rigid shell" boots, such as ski boots, ice skate and roller skate boots, hiking boots, etc., which have a comfort liner housed within their shell.

In these footwear, the known tongue fixing means determine a longitudinal fixed mounting position, or procure a plurality of possibilities of adjustment between two longitudinal extreme positions, either continuously or adjustably, especially by means of woven strips that attach to one another by contact.

The patents EP 0 317 798, FR 2 682 858, and U.S. Pat. No. 4,805,321 can be cited, which describe such footwear, as well as the "RACE, CARVE, FREE" ski boot models sold under the mark ROSSIGNOL in 1999.

More specifically, the patent EP 0 317 798 discloses a liner having a tongue sliding between two longitudinal extreme positions determined by means of an assembly axle that is Sly mounted through an oblong slot. Thus mounted, the tongue is supposed to displace itself automatically against the front portion of the user's leg when the boot shell is closed on the liner. However, due to the fact that its longitudinal displacement essentially occurs beneath the lateral walls of the liner, and that it results from the constraint ex d by the elements for closing the shell on the liner, substantial frictions are generated between it and these contiguous portions of the liner and of the shell which hinder its sliding. In fact, it is the user of the boot who, almost generally, must manually ensure the adjustment of the tongue against the front portion of the leg.

Another disadvantage relates to tie necessity of attaching a relatively rigid reinforcement element on the front of the liner to obtain a sliding and solid linkage with the tongue. This arrangement complicates the construction of the liner and prevents the adjustment thereof on the user's foot, in the area of the reinforcement element. Moreover, because the linkage occurs between the oblong slot, which is obtained in this reinforcement element, and the assembly shaft, the removability of the tongue in view of its replacement is impossible without destroying one of the constituent elements of this linkage.

In the case of the liner described in the patent FR 2 682 858, the aforementioned disadvantages resulting from the frictions that are generated between the tongue and he contiguous portions of the liner and of the shell are avoided. Indeed, in this example, the tongue is simply retained on the liner in a position predetermined by means of removable latching means. Conversely, there are no longer any possibilities of adjustment in he longitudinal position to adjust it on the front portion of the user's leg and foot. Moreover, a liner of tis type requires a certain free space to be provided between the shell and the front of the liner where the means for latching the tongue are located. Indeed, because the latter are relatively projecting and extend over a reduced surface, they are susceptible of causing painful pressure spots on the user's foot, since the boot shell is adjusted in their area. This type of problem, already mentioned in reference to the liner described in the patent EP 0 317 798, is avoided in the constructions where the front opening footwear has a tongue for protecting the top of the foot, which is attached at its front end by means of an adjustable fixing system constituted of woven strips that grip by contact, one of the strips constituting an extension of the front end of the tongue. Indeed, as taught by the patent U.S. Pat. No. 4,805,321 and by the liners with which the "RACE, CARVE, FREE" boot models of the mark ROSSIGNOL are equipped, the strips are easily incorporated into the general stricture of the boot due to their thinness and flexibility, as well as their contact surface. Since they do not have any locally projecting portions or any reinforcement element, the tongue linkage strips therefore make it possible to adjust the fitting volume to the user's foot without causing any problems capable of hindering comfort. Furthermore, due to the fact that the fixing of the tongue merely results from the woven fibers of the strips overlapping one another, there is a multitude of possibilities of adjustment of the longitudinal position of the tongue. Of course, the larger the contact surface of the woven strips, the higher the number of adjustment possibilities.

This fixing method is generally satisfactory for the aforementioned reasons, but has the disadvantage of not being solid, in particular of not being resistant to the stresses which the tongue imposes thereon tranlationally in the longitudinal axis of the boot, because one of the woven strips is directly fixed on the tongue. Thus, these stresses resulting from the least flexional movements of the shell and/or upper of the boot cause, by constant repetitions, folds at the front end of the tongue and the progressive detachment of the woven strips until completely releasing the tongue. This is what almost generally occurs when the tongue is pre-adjusted in a position in which the woven strips are not in mesh over their entire gripping surface. Similarly, when the user exerts a traction on the tongue in view of flattening it against his lower leg and/or on the top of the foot, when putting on the boot, the tongue often disengages.

SUMMARY OF THE INVENTION

An object of the present invention is to overcome the various disadvantages of the tongue fixing systems described hereinabove, and especially proposes a fixing system which facilitates:

- adjusting the longitudinal position of the tongue continuously, and stopping it solidly in the position selected between two end adjustment positions;
- referencing the position for adjusting the tongue relative in particular to the end adjustment positions;
- undertaking the possible replacement of the tongue without destroying any element thereof or of the fixing system;
- adjusting the fitting volume to the user's foot without causing painful pressure spots; and
- leaving the tongue free to move pivotally in a vertical plane to facilitate putting on and taking off the boot.

To this end, the invention is directed to an item of footwear having an opening at the front and having a tongue for protecting the top of the foot, which is attached at its front end by means of an adjustable fixing system having woven strips that attach to one another by contact, the fixing system being constituted of at least one thin flexible band, oriented in the longitudinal axis of the footwear, which is fixed at one end on the front end of the footwear and is folded over itself, at its other free end, to form a loop for retaining the tongue, woven strips being affixed to the flexible band on the side where it is folded in order to ensure the closure of the loop thus formed.

Due to these characteristics, the position of the tongue in dt longitudinal direction of the shoe or boot can be adjusted by simply modifying the woven strip position for attachment to one another, and this continuously due to the fact that the woven fibers of the strips can overlap one another almost at any point. The present fixing system with woven strips attaching to one another by contact allows the easy replacement of the tongue, since it does not require destroying any element of the footwear.

Furthermore, with respect to a flexible and thin band, the folding of the latter to form a loop for attaching the tongue can be done along a small radius that does not substantially increase the exterior volume of the front end of the shoe/boot. Moreover, due to the fact that the flexible band has a certain surface, the possible pressures that could be applied thereon would be distributed over this surface. The fixing system is therefore easy to integrate into the general structure of the footwear, especially when it is a comfort liner housed in the shell of a boot by virtue of its thinness, its flexibility-suppleness, as well as the extent of its contact surface.

According to another characteristic, the protective tongue has, at its front end, a transverse attachment arrangement on which the flexible band loops. The tongue can thus pivot in a vertical plane due to its attachment arrangement which rotates in the loop formed by the flexible band. Consequently, one can avoid the formation of folds at the front end of the tongue, which, as a result from constantly putting on and taking off the boot, usually occurs in the tongues that are sewn and/or fixed by means of woven strips which constitute an extension of the tongues, as disclosed previously.

This attachment arrangement includes, for example, a bar transverse to the longitudinal axis of the shoe/boot. According to another example, the attachment arrangement includes a ring whose one portion, on which the flexible band loops, extends transversely to the longitudinal ax of the shoe/boot.

Advantageously, a closed contour opening corresponding substantially to the transverse profile of the flexible band is obtained in the front end of the tongue, contiguous to the attachment arrangement. With this arrangement, the flexible band can pass through, at. its free end, at the same time as it loops on the attachment arrangement; this assembly makes it possible to limit the subsequent translational displacements of the tongue in the longitudinal direction of the shoe/boot and toward the front of the latter, because the tongue then finds a supplemental support in the area of the loop formed by the flexible band, by means of the contour of the opening which it has, and which abuts on the loop.

In order to have a maximum number of positions for the longitudinal adjustment of the tongue attachment loop, the entire surface of the flexible band, which is directed on the side where the latter is folded, is covered by the woven strips. In this way, one can make the woven strips cooperate with one another in several areas comprised between two extreme longitudinal positions of mutual attachment. Advantageously, these two extreme positions are indicated on the front portion of the footwear and/or on the flexible band, for example, by a reference mark to notify of the limits not to exceed in order to guarantee a minimum gripping surface in mesh, and thus a certain solidity of the retaining-fixing of the tongue on the footwear.

According to a preferred embodiment of the invention, which furthermore corresponds to the location of the tongue for protecting the top of the foot, the tongue extends beneath the transverse flaps of the footwear, especially under the tightening and/or retention devices, such as the lacing devices which secure the flaps on the foot. More specifically, the tongue at least has its lateral edges which extend beneath the transverse flaps of the footwear, whereas its front end, provided with the attachment arrangement, exits on the exterior of the flaps, on the front end of the footwear.

BRIEF DESCRIPTION OF DRAWINGS

The invention will be better understood from the following description, with reference to the annexed drawings showing, by way of example, how the tongue of the footwear can be fixed, and in which.

DETAILED DESCRIPTION OF THE INVENTION

Figure 1:
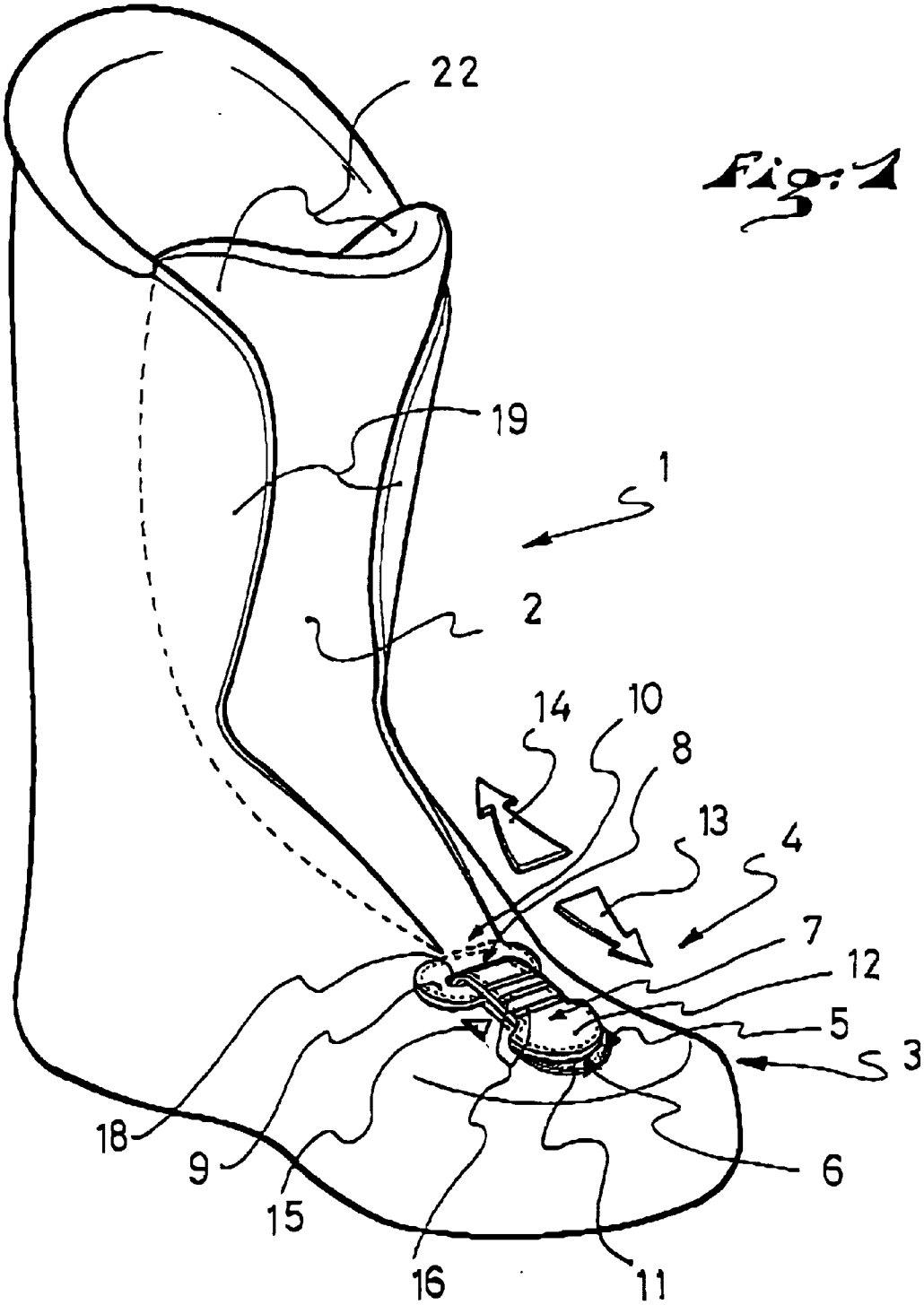
FIG. 1 shows a perspective view of an item of footwear, such as a comfort liner adapted to be housed in the shell of a boot, provided with a tongue according to the invention.
Figure 2:
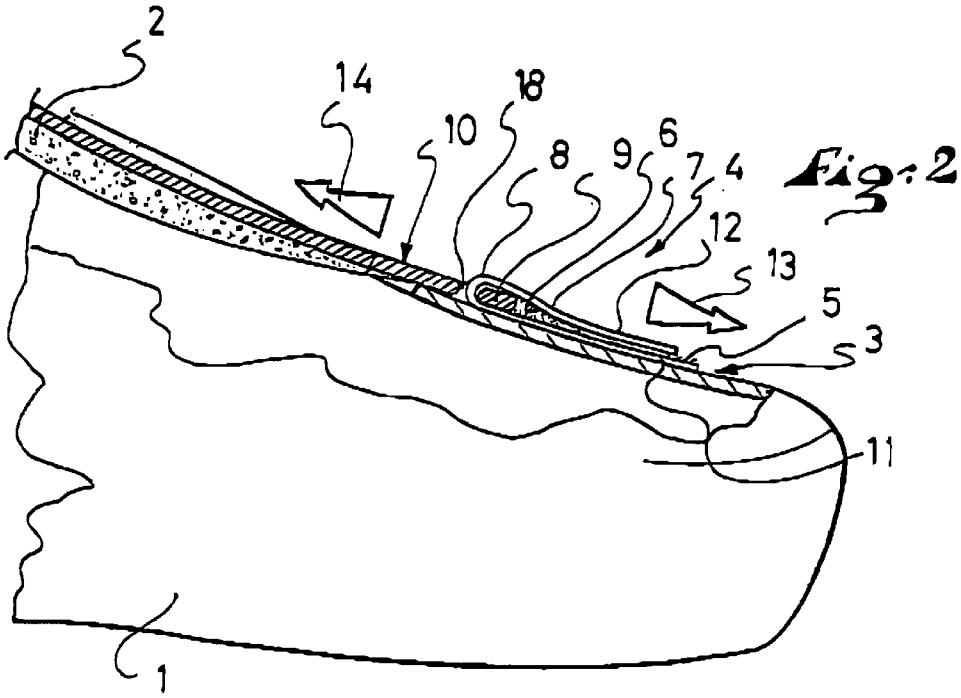
FIG. 2 shows a partial longitudinal cross-sectional view of the front portion of the liner of FIG. 1, with the device for fixing the tongue.

The article of footwear shown in FIGS. 1 and 2 is a comfort liner 1 which opens at the front and has a comfort tongue 2 adapted to come into contact directly with the top of the foot, not shown. The tongue 2 is attached at the front end 3 of the liner 1 by means of a fixing system 4, adjustable by means of fabric or woven strips 5 and 6 that attach to one another by contact. Strips 5 and 6 can take the form of a hook and loop fastening mechanism of the Velcro type, for example. This fixing system 4 includes a flexible and thin band 7 provided with woven strips 5 and 6 and folded over itself so as to form a loop 8 adapted to retain an attachment device 9 provided at the front end 10 of the tongue 2. The woven strips 5 and 6 are affixed to the flexible band 7 on the side where it is folded in order to ensure the closure of the loop 8 which it forms.

To adjust the position of the tongue, 2 longitudinally on the footwear 1, the flexible band 7 is oriented along the longitudinal axis of the latter and is fixed at its end 11 on the front end 3 of the latter. In this way, it suffices to modify the attachment position of the free end 12 relative to the fixed end 11 to cause the displacement of the loop 8 whose axis is perpendicular to the longitudinal axis of the footwear 1. The attachment device 9 of the tongue 2 is also provided to have an as perpendicular to the longitudinal axis of the footwear 1; in this way, the tongue 2 remains free to move in the vertical direction by pivoting on its attachment device 9, which facilitates putting on and taking off the boot.

These different arrangements make it possible to adjust the tongue 2 either forwardly or rearwardly, as indicated by the arrows 13 and 14, respectively, by simply modifying the folded length of the free end 12 of the flexible band 7 on the fixed end 11. This is made possible by the fact that the woven fibers of the strips 5 and 6, with which the ends 11 and 12 of the flexible band 7 are provided, can overlap one another at any point. To have a large adjustment range, the entire surface of the flexible band 7, which is directed toward the side where the latter is folded, is covered by the woven strips 5 and 6, and the free end 12 is provided to be relatively longer than the fixed end 11. Thus, one can modify the attachment position of the free end 12 between two extreme adjustment positions by preserving a gripping surface, in mesh with the fixed end 11, that remains sufficient to guarantee the solid closure of the loop 8. Advantageously, at least one reference mark 15, fixed on the front portion 3 of the footwear 1, makes it possible to indicate and/or mark the adjustment limits of the free end 12 of the flexible band 7 not to be exceeded to be sure to have this minimum gripping surface in mesh. In connection with this reference mark 15, marks 16 are provided on the flexible band 7 so as to render more visible the position(s) of longitudinal adjustment of the loop 8, and therefore of the tongue 2 by means of its attachment device 7.

According to a construction detail, which is more visible in FIG. 2, a closed contour opening or slot 18 is presented in the front end 10 of the tongue 2, the attachment device 9 of the latter demarcating this opening 18 on the side directed toward the front end 3 of the footwear 1. The closed contour of the opening 18 is determined so as to correspond approximately to the transverse profile of the flexible band 7, such that the tongue 2 cannot move translationally subsequent to its adjustment. In fact, in the absence of play between the flexible band 7 and the opening 18, the tongue 2 is supported directly on the loop 8 before biasing the woven strips 5 and 6. This arrangement renders such a fixing system 4 markedly more efficient during retention than the fixing systems in which the woven strips are arranged in part on the tongue and in part on the footwear, as is the case in devices known in the art. In any event, when the tongue 2 is biased translationally toward the rear, its attachment device 9 pulls on the two ends 11 and 12 of the flexible band 7, and therefore on the two woven strips 5 and 6, simultaneously and in the same direction. Consequently, the strips 5 and 6 can be separated from one another only by overcoming their resistance to separation that is increased by the resistance to deformation of the loop 8 of the flexible band 7, and by the friction occurring between the latter and the attachment device 9 of the tongue 2.

The pulling out of the tongue 2 thus becomes practically impossible, especially during the manual adjustment thereof by traction to flatten it on the top of the foot and lower leg of the user.

According to another construction detail, the lateral edges 22 of the tongue 2 extend beneath the transverse flaps 19 of the footwear 1, whereas its front end 10 provided with the attachment device 9 exits on the front end 3 of the footwear 1. This arrangement makes it possible to provide the front end 10 of the tongue 2 with a general shape that is similar to a T whose transverse bar, provided with the attachment device 9, extends relatively beyond the transverse flaps 19 in this area of the fixing system 4, whereas the vertical bar of the T is adjusted to the spacing of the flaps. This assembly of the front end 10 of the tongue 2 reinforces its retention in position on the footwear 1.

Figure 3:
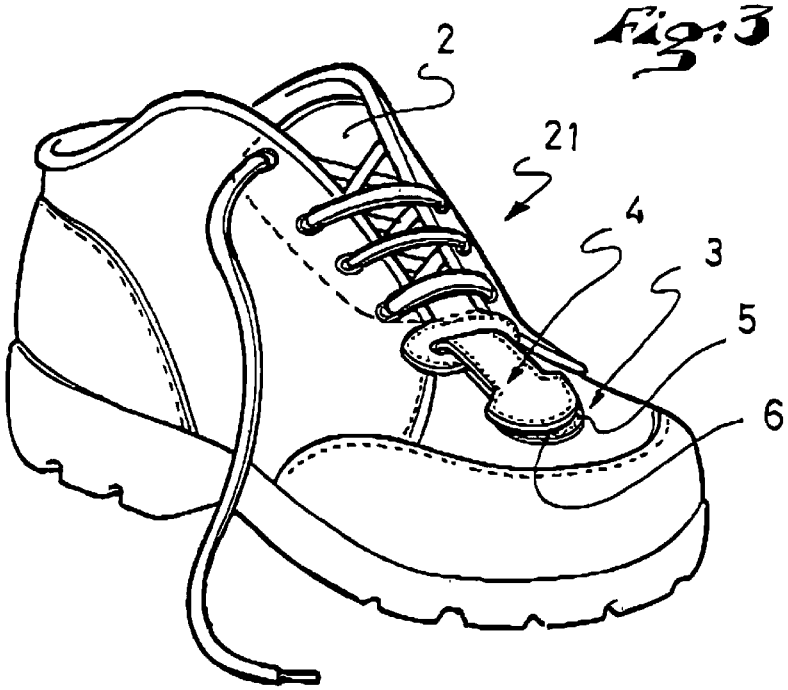
FIG. 3 shows a perspective view of another item of footwear, such as a flexible walking shoe, provided with a tongue with its fixing device.

In FIG. 3, the footwear 21 shown is a flexible walking shoe. In a manner similar to the footwear 1 disclosed with reference to FIGS. 1 and 2, it has a tongue 2 that is attached to the front end 3 of the footwear 21 by means of a fixing system 4 having woven strips 5 and 6. Since all the constituent elements used to fix and adjust the tongue 2 are similar to the embodiment of FIGS. 1 and 2, they are not described again.

The invention is not limited to the particular footwear disclosed hereinabove. In this regard, it is intended that the invention can be applied to sports boots, such as boots for roller skates, ice skates, cross country skiing, etc.

Furthermore, modifications can be envisioned without leaving the scope of the invention. For example, the device 9 for attaching the tongue 2 can be constituted by an attachment bar, or by an attachment ring. In this latter case, the ring can advantageously have an approximately oval shape, such as an O, and can be mounted on the front end 10 of the tongue 2, transversely to the longitudinal axis of the footwear 1, 21, such that the ends of the O extend beyond the transverse flaps 19 thereof.

Finally, the tongue 2, which is preferably arranged beneath the transverse flaps 19 of the footwear so as to ensure the most efficient protection possible, can nevertheless be arranged above these flaps 19.

The instant application is based upon French Patent Application No. 99.03915, filed Mar. 26, 1999, the disclosure of which is hereby incorporated by reference thereto in its entirety, and the priority of which is hereby claimed under 35 U.S.C. §119.

What is claimed is:

1. An article of footwear comprising:

a front opening and a front end;

a tongue for protecting a top of a foot of a wearer;

an adjustable fixing system for attaching said tongue at said front end, said adjustable fixing system comprising at least one flexible band, said flexible band being distinct with respect to said tongue, said flexible band being oriented along a longitudinal axis of the article of footwear, said flexible band having a fixed end, a free end, and an inner surface, said fixed end of said flexible band being fixed to said front end of the article of footwear, said flexible band further being folded over whereby said inner surface at said free end of said flexible band is positioned above and faces said inner surface of said flexible band at said fixed end to form a loop for retaining said tongue, said adjustable fixing system further comprising material strips, attachable by contact, at least on said inner surfaces of said fixed and free ends of said flexible band, to ensure closure of said loop.

2. An article of footwear according to claim 1, wherein:

said material strips are a woven material.

3. An article of footwear according to claim 1, wherein:

said material strips comprise a hook and loop fastening mechanism.

4. An article of footwear according to claim 1, wherein:

said tongue has a front end and an attachment device at said front end, said flexible band being looped around said attachment device.

5. An article of footwear according to claim 4, wherein:

said material strips extend substantially over an entirety of said inner surface of said flexible band, whereby said material strips are cooperable with each other in a plurality of positions, longitudinal to the article of footwear, the respective surfaces of said material strips providing a sufficient gripping force to guarantee a solid attachment to one another, and thus to guarantee solid fixing of said tongue extending in said loop formed by said flexible band.

6. An article of footwear according to claim 5, wherein:

said attachment device for attaching the tongue is constituted by a bar transverse to a longitudinal axis of the article of footwear.

7. An article of footwear according to claim 6, wherein:

said bar of said attachment device demarcates, in said front end of said tongue, a closed contour opening, said free end of said flexible band passing through said opening prior to said flexible band being folded over.

8. An article of footwear according to claim 7, wherein:

said flexible band with said material strips has a transverse profile; and said closed contour opening has a shape corresponding substantially to said transverse profile of said flexible band provided with said material strips.

9. An article of footwear according to claim 6, further comprising:

transverse flaps positioned on opposite sides of said front opening;

said tongue further comprising lateral edges extending beneath said transverse flaps; and said bar of said attachment device being positioned on an exterior of said flaps, on said front end of said article of footwear.

10. An article of footwear according to claim 9, wherein:

said front end of said tongue has a general T-shape, said T-shape including a transverse member constituted by said bar of said attachment device, which cooperates with the flexible band of the fixing system, said T-shape further including a vertical member approximately adjusted to a spacing between said transverse flaps of the article of footwear in said front end.

11. An article of footwear according to claim 4, wherein:

said attachment device of said tongue is constituted by a ring.

12. An article of footwear according to claim 11, further comprising:

transverse flaps positioned on opposite sides of said front opening;

said tongue further comprising lateral edges extending beneath said transverse flaps; and said ring of said attachment device being positioned on an exterior of said flaps, on said front end of said article of footwear.

13. An article of footwear according to claim 1, wherein:

a reference mark is arranged at said front end of the article of footwear, in the area of said flexible band, said reference mark serving as an indicator for a plurality of positions for adjusting said material strips with respect to one another between at least two extreme adjustment positions not to be exceeded in order to guarantee a minimum gripping surface in mesh between said material strips.

14. An article of footwear comprising:

a front opening and a front end;

a tongue for protecting a top of a foot of a wearer;

an adjustable fixing system for attaching said tongue at said front end, said adjustable fixing system comprising at least one flexible band oriented along a longitudinal axis of the article of footwear, said flexible band having a fixed end, a free end, and an inner surface, said fixed end of said flexible band being fixed to said front end of the article of footwear, said flexible band further being folded over whereby said inner surface at said free end of said flexible band is positioned above and faces said inner surface of said flexible band at said fixed end to form a loop for retaining said tongue, said adjustable fixing system further comprising material strips, attachable by contact, on at least on said inner surfaces of said fixed and free ends of said flexible band, to ensure closure of said loop; and wherein said tongue has a front end and an attachment device at said front end, said flexible band being looped around said attachment device.

15. An article of footwear according to claim 14, wherein:

said material strips are made of a fabric material.

16. An article of footwear according to claim 14, wherein:

said material strips comprise a hook and loop fastening mechanism.

17. An article of footwear comprising:

a longitudinally extending opening and a tongue positioned within said opening for protecting a top of a foot of a wearer, said tongue having a slot at a front end of the tongue;

an adjustable fixing system for attaching said tongue at a front end of the article of footwear, said adjustable fixing system comprising a longitudinally extending flexible band, said flexible band having a fixed end, a free end, and an inner surface, said fixed end of said flexible band being fixed to said front end of the article of footwear, said flexible band extending rearwardly from said fixed end and extending through said slot at said front end of said tongue, said flexible band further extending forwardly from said slot, whereby said inner surface at said free end of said flexible band is positioned above and faces said inner surface of said flexible band at said fixed end to form a loop for retaining said tongue, said adjustable fixing system further comprising contact-attachable strips on at least on said inner surfaces of said fixed and free ends of said flexible band, to ensure closure of said loop.

18. An article of footwear according to claim 17, wherein:

said contact-attachable strips are constituted by a hook and loop fastening mechanism.

* * * * *